US006562230B1

(12) United States Patent
O'Rear et al.

(10) Patent No.: US 6,562,230 B1
(45) Date of Patent: May 13, 2003

(54) SYNTHESIS OF NARROW LUBE CUTS FROM FISCHER-TROPSCH PRODUCTS

(76) Inventors: Dennis O'Rear, 40 Upland Dr., Petaluma, CA (US) 94952; Russell R. Krug, 44 Olympia Way, Novato, CA (US) 94949

( * ) Notice: Subject to any disclaimer, the term of this patent is extended or adjusted under 35 U.S.C. 154(b) by 0 days.

(21) Appl. No.: 09/469,574

(22) Filed: Dec. 22, 1999

(51) Int. Cl.[7] ..... C10G 69/02; C07C 6/00

(52) U.S. Cl. ..... 208/66; 208/18; 208/19; 208/93; 208/46; 208/95; 585/644; 585/643; 585/324; 585/1; 585/2

(58) Field of Search ..... 585/644, 643, 585/324, 1, 2; 208/18, 19, 93, 46, 66, 95

(56) References Cited

U.S. PATENT DOCUMENTS

| | | | | | |
|---|---|---|---|---|---|
| 2,405,996 | A | * | 8/1946 | Burk | 208/14 |
| 3,634,538 | A | * | 1/1972 | Steffgen | 585/644 |
| 3,668,268 | A | | 6/1972 | Mulaskey | |
| 3,723,562 | A | * | 3/1973 | Heckelsberg | 585/324 |
| 3,726,938 | A | * | 4/1973 | Berger | 585/314 |
| 3,763,032 | A | * | 10/1973 | Banks | 208/93 |
| 3,852,207 | A | | 12/1974 | Stangeland et al. | |
| 3,856,876 | A | | 12/1974 | Burnett | |
| 3,904,513 | A | | 9/1975 | Fischer et al. | |
| 3,914,330 | A | | 10/1975 | Hughes | |
| 4,157,294 | A | | 6/1979 | Iwao et al. | |
| 4,255,605 | A | * | 3/1981 | Dixon | 585/332 |
| 4,347,121 | A | | 8/1982 | Mayer et al. | |
| 4,401,556 | A | | 8/1983 | Bezman et al. | |
| 4,579,986 | A | | 4/1986 | Sie | |
| 4,810,357 | A | | 3/1989 | Chester et al. | |
| 4,820,402 | A | | 4/1989 | Partridge et al. | |
| 4,827,064 | A | * | 5/1989 | Wu | 585/10 |
| 4,827,073 | A | * | 5/1989 | Wu | 585/530 |
| 4,913,799 | A | | 4/1990 | Gortsema et al. | |
| 4,920,691 | A | * | 5/1990 | Fainman | 44/57 |
| 4,941,981 | A | | 7/1990 | Perricone et al. | |
| 4,962,249 | A | * | 10/1990 | Chen et al. | 585/329 |
| 5,059,567 | A | | 10/1991 | Linsten et al. | |
| 5,073,530 | A | | 12/1991 | Bezman et al. | |
| 5,082,986 | A | | 1/1992 | Miller | |
| 5,096,883 | A | | 3/1992 | Mercer et al. | |
| 5,113,030 | A | * | 5/1992 | Chen et al. | 585/10 |

(List continued on next page.)

FOREIGN PATENT DOCUMENTS

| | | |
|---|---|---|
| EP | 0921184 | 6/1999 |
| WO | 97/21788 | 6/1997 |

OTHER PUBLICATIONS

"Modern Petroleum Technology", 3rd edition (1962), Evens, p. 671, lines 15–22. –no month.*

Deckwer, Wolf–Dieter, et al., "Modeling the Fischer–Tropsch Synthesis in the Slurry Phase", Ind. Eng. Chem. Process Des. Dev., v21, No. 2, pp. 231–241, 1982. –no month.

(List continued on next page.)

*Primary Examiner*—Nadine G. Norton
(74) *Attorney, Agent, or Firm*—Burns, Doane, Swecker & Mathis, L.L.P.

(57) ABSTRACT

A process for preparing hydrocarbons in the lube base oil range, lube base oils and lube oil compositions from a fraction with an average molecular weight above a target molecular weight and a fraction with an average molecular weight below a target molecular weight via molecular averaging is described. The fractions can be obtained, for example, from Fischer-Tropsch reactions, and/or obtained from the distillation of crude oil. Molecular averaging converts the fractions to a product with a desired molecular weight, for use in preparing a lube oil composition. The product can optionally be isomerized to lower the pour point, and also can be blended with suitable additives for use as a lube oil composition.

31 Claims, 1 Drawing Sheet

U.S. PATENT DOCUMENTS

| | | | | | |
|---|---|---|---|---|---|
| 5,114,563 | A | | 5/1992 | Lok et al. | |
| 5,135,638 | A | | 8/1992 | Miller | |
| 5,189,012 | A | | 2/1993 | Patel et al. | |
| 5,198,203 | A | | 3/1993 | Kresge et al. | |
| 5,200,101 | A | | 4/1993 | Hsu et al. | |
| 5,210,347 | A | * | 5/1993 | Chen et al. | 585/14 |
| 5,246,566 | A | | 9/1993 | Miller | |
| 5,246,689 | A | | 9/1993 | Beck et al. | |
| 5,282,958 | A | | 2/1994 | Santilli et al. | |
| 5,334,368 | A | | 8/1994 | Beck et al. | |
| 5,348,982 | A | | 9/1994 | Herbolzheimer et al. | |
| 5,898,023 | A | | 4/1999 | Francisco et al. | |
| 6,008,164 | A | | 12/1999 | Aldrich et al. | |
| 6,166,279 | A | * | 12/2000 | Schwab et al. | 585/324 |
| 6,225,359 | B1 | * | 5/2001 | O'Rear et al. | 518/706 |
| 6,369,286 | B1 | * | 4/2002 | O'Rear | 585/644 |

OTHER PUBLICATIONS

Kölbel, Herbert, et al., "The Fischer–Tropsch Synthesis in the Liquid Phase", Catal. Rev.–Schi. Eng., v.21(n), pp. 225–274, 1980. –no month.

Beck, J. S., et al., "A New Family of Mesoporous Molecular Sieves Prepared with Liquid Crystal Templates", J. Am. Chem. Soc., 114, 10834–10843, 1992. –no month.

Kresge, C. T., et al., "Ordered Mesoporous Molecular Sieves Synthesized by a Liquid–Crystal Template Mechanism", Nature, vol. 359, pp. 710–712, 1992. –no month.

Hepp, H. J., et al., "Industrial and Engineering Chemistry", vol. 45, pp. 112–114, 1953. –no month.

Maleville, X., et al., "Oxidation of Mineral Base Oils of Petroleum Origin: The Relationship between Chemical Composition, Thickening, and Composition of Degradation Products", Lubrication Science 9(1), pp. 3–60, 1996. –no month.

Mirozopeva, Naftekhimiya 28(6), pp. 831–837, 1988. –no month.

Shah, Y. T., et al., "Design Parameters Estimations for Bubble Column Reactors", AlChE Journal, vol. 28, No. 3, pp. 343–379, May 1982.

Ramachandran, P. A., "Bubble Column Slurry Reactor" Three–phase Catalytic Reactors, Gordon and Breach, 1983, pp. 308–332 (Chapter 10). –no month.

* cited by examiner

SYNTHESIS OF NARROW LUBE CUTS FROM FISCHER-TROPSCH PRODUCTS

RELATED APPLICATION

This application is related to "Process for Conversion of Natural Gas and Associated Light Hydrocarbons to Salable Products" by Dennis J. O'Rear, Charles L. Kibby and Russell R. Krug, filed concurrently with this application.

FIELD OF THE INVENTION

This invention relates to the molecular averaging of various feedstocks to form lube oils.

BACKGROUND OF THE INVENTION

There is a need for lubricating oils in the $C_{30}$+ range which have a high viscosity index (VI) and good oxidation stability. The majority of lubricating oils used in the world today are derived from crude oil, and include a petroleum base oil and an additive package. The base oils are refined from crude oil through a plurality of processes such as distillation, hydrocracking, hydroprocessing, catalytic dewaxing, and the like. Hydrocarbons in the lube oil boiling range from these processes needs to be further processed to create the finished base oil. In creating the base oil, the refiner desires to obtain the highest possible yield while preserving the VI of the oil.

Crude oil fractions in the $C_{30}$+ range often tend to include waxes. Since the presence of wax in lube oil adversely affects various physical properties, such as the pore point and cloud point, the waxy components are typically removed. The waxy components of the oil can be removed using various processes, including solvent dewaxing and/or catalytic dewaxing, both of which tend to provide lower yields at a given VI. It would be highly desirable to have a process that optimizes the yield of lube oil at a given VI.

The use of crude oil as a feedstock for preparing lube oils is limited by the product loss associated with the steps required to remove the waxy components. Further, crude oil is in limited supply, it includes aromatic compounds believed to cause cancer, and contains sulfur and nitrogen-containing compounds that can adversely affect the environment.

Lube oils can also be prepared from natural gas. This involves converting natural gas, which is mostly methane, to synthesis gas (syngas), which is a mixture of carbon monoxide and hydrogen, and subjecting the syngas to Fischer-Tropsch reaction conditions. An advantage of using fuels prepared from syngas is that they do not contain significant amounts of nitrogen or sulfur and generally do not contain aromatic compounds. Accordingly, they have minimal health and environmental impact.

A limitation associated with Fischer-Tropsch chemistry is that it tends to produce a broad spectrum of products, ranging from methane to wax. While the product stream includes a fraction useful as lube oils, it is not the major product. Product slates for syngas conversion over Fischer-Tropsch catalysts (for example, Fe, Co and Ru) are controlled by polymerization kinetics with fairly constant chain growth probabilities that fix the possible product distributions. Heavy products with a relatively high selectivity for wax are produced when chain growth probabilities are high. Methane is produced with high selectivity when chain growth probabilities are low.

It is generally possible to isolate various fractions from a Fischer-Tropsch reaction, for example, by distillation. The fractions include, among others, a gasoline fraction (B.P. about 68–450° F./20–232° C.), a middle distillate fraction (B.P. about 250–750° F./121–399° C.), a wax fraction (B.P. about 650–1200° F./343–649° C.) primarily containing $C_{20}$ to $C_{50}$ normal paraffins with a small amount of branched paraffins and a heavy fraction (B.P. above about 1200° F./649° C.) and tail gases. A suitable fraction for use in preparing a lube oil can be isolated from the product stream by distillation. However, depending on market considerations, it might be advantageous to provide a process that would convert the other fractions into fractions suitable for use in preparing lube oils. The present invention provides such a process.

SUMMARY OF THE INVENTION

In its broadest aspect, the present invention is directed to an integrated process for producing hydrocarbons in the lube base oil range, lube base oils and lube oils. As used herein, lube base oils are generally combined with an additive package to provide finished lube oils. Hydrocarbons in the lube base oil range are prepared via molecular averaging of a relatively low molecular weight fraction and a relatively high molecular weight fraction.

The resulting hydrocarbons tend to be waxy unless they are isomerized prior to the molecular averaging step. Isomerization of the hydrocarbons provides a lube base oil, which, when combined with the additive package, provides a lube oil composition. Catalytic isomerization improves the pour point and viscosity index. Hydrotreatment can optionally be performed on the hydrocarbons or lube base oil to hydrotreatment to remove olefins, oxygenates and other impurities.

Depending on the desired physical and chemical properties of the lube oil composition, the product of the molecular averaging reaction can include virtually any combination of hydrocarbons between $C_{20}$ and $C_{50}$. Preferably, the lube oil composition includes mostly hydrocarbons in the range of around $C_{30}$. When preparing a lube base oil composition in the $C_{20}$ to $C_{50}$ range, one can combine hydrocarbon materials below $C_{20}$ and above $C_{50}$ and subject them to molecular averaging to arrive at a composition in the desired range. When preparing a lube base oil composition in the $C_{30}$ range, for example, $C_{20}$ and $C_{40}$ fractions can be combined and subjected to molecular averaging.

In one embodiment, the process involves performing Fischer-Tropsch synthesis on syngas to provide a range of products, isolating various fractions via fractional distillation, and performing molecular averaging on a relatively low molecular weight fraction and a relatively high molecular weight fraction to provide a product with a molecular weight between the low and high molecular weights, which is suitable for use in preparing a lube base oil composition. In another embodiment, relatively low molecular weight and/or relatively high molecular weight fractions are obtained from another source, for example, via distillation of crude oil, provided that the fractions do not include appreciable amounts (i.e., amounts which would adversely affect the catalyst used for molecular averaging) of thiols, amines, or cycloparaffins.

It may be advantageous to take representative samples of each fraction and subject them to molecular averaging reactions, adjusting the relative proportions of the fractions until a product with desired properties is obtained. Then, the reaction can be scaled up using the relative ratios of each of the fractions that resulted in the desired product. Using this method, one can "dial in" a molecular weight distribution which can be roughly standardized between batches and result in a reasonably consistent product.

BRIEF DESCRIPTION OF THE DRAWING

The FIGURE is a schematic flow diagram representing one embodiment of the invention.

DETAILED DESCRIPTION OF THE INVENTION

Figure 1:
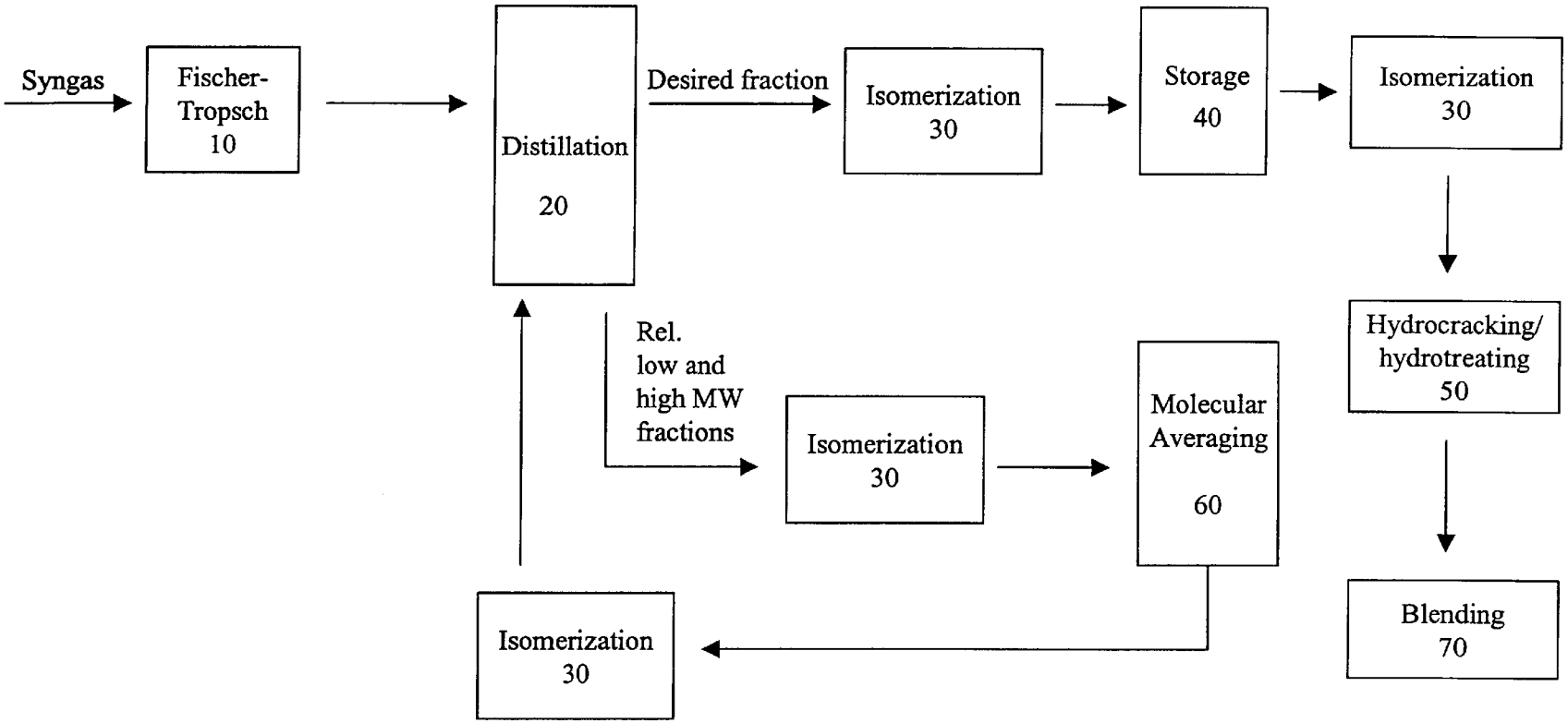

In its broadest aspect, the present invention is directed to an integrated process for producing hydrocarbons in the lube base oil range, lube base oils and lube oils via molecular averaging of relatively low molecular weight and relatively high molecular weight fractions, for example, $C_{20}$ and $C_{40}$ fractions. The lube base oil composition includes hydrocarbons in the range of between about $C_{20}$ and $C_{50}$, but is preferably around $C_{30}$.

As used herein, "hydrocarbons in the lube base oil range" are hydrocarbons having a boiling point in the lube oil range (i.e., between 650° F. and 1200° F.). As used herein, a "relatively low molecular weight fraction" is a fraction with an average molecular weight lower than the average molecular weight of the desired lube oil composition. A "relatively high molecular weight fraction" is a fraction with an average molecular weight higher than the average molecular weight of the desired lube oil composition. "Average molecular weight" is molar average molecular weight. Preferably, the relatively high and relatively low molecular weight fractions are each within about 10 carbons from that of the desired product. However, the process described herein can tolerate broader differences in molecular weight.

An important consideration for determining an appropriate ratio of high molecular weight and low molecular weight fractions is that the average molecular weight of the two fractions, taking into consideration the relative proportions of each fraction, is close to the desired average molecular weight. Because of reactivity differences, it is possible to have an excess of one component, in particular, the lower molecular weight fraction.

In one embodiment, the process involves performing Fischer-Tropsch synthesis on syngas to provide a range of products, isolating various fractions via fractional distillation (including relatively high and relatively low molecular weight fractions), and performing molecular averaging on the relatively low molecular weight and relatively high molecular weight fractions. Alternatively, the relatively low molecular weight and/or relatively high molecular weight fractions are obtained from another source, for example, via distillation of crude oil, provided that the fractions do not include an appreciable amount of olefins, heteroatoms or saturated cyclic compounds.

The product from the molecular averaging reaction typically includes hydrocarbons with molecular weights between the low and high molecular weights. A suitable fraction can be isolated, for example, by distillation, which fraction contains hydrocarbons in the lube base oil range. These hydrocarbons generally are waxy solids, but can be readily isomerized to form a lube base oil composition. The lube base oil composition can be blended with suitable additives to form the lube base oil composition.

The process described herein is an integrated process. As used herein, the term "integrated process" refers to a process which involves a sequence of steps, some of which may be parallel to other steps in the process, but which are interrelated or somehow dependent upon either earlier or later steps in the total process.

An advantage of the present process is the effectiveness with which the present process may be used to prepare high quality base oils useful for manufacturing lubricating oils, and particularly with feedstocks which are not conventionally recognized as suitable sources for such base oils.

Lube Base Oil Composition

The lube base oil prepared according to the process described herein can have virtually any desired molecular weight, depending on the desired physical and chemical properties of the lube oil composition, for example, pour point, viscosity index and the like. The molecular weight can be controlled by adjusting the molecular weight and proportions of the high molecular weight and low molecular weight fractions. Lube oil compositions with boiling points in the range of between about 650° F. and 1200° F. are preferred, with boiling points in the range of between about 700° F. and 1100° F. being more preferred. The currently most preferred average molecular weight is around $C_{30}$, which has a boiling point in the range of roughly 840° F., depending on the degree of branching. However, the process is adaptable to generate higher molecular weight lube oils, for example, those in the $C_{35}$–$C_{40}$ range, or lower molecular weight lube oils, for example, those in the $C_{20}$–$C_{25}$ range. Preferably, the majority of the composition includes compounds within about 8 carbons of the average, more preferably, within around 5 carbons of the average.

In a preferred embodiment, the composition includes branched hydrocarbons. The products of the Fischer-Tropsch synthesis tend to be linear, which can result in a relatively high pour point. However, the linear products can be isomerized readily using known isomerization chemistry, or, alternatively, the reactants subjected to molecular averaging can be isomerized before the molecular averaging step. Accordingly, the preferred lube base oil composition can generally be described as including hydrocarbons in the $C_{20}$–$C_{50}$, preferably around $C_{30}$ range which include branching typical of that observed in compositions subjected to catalytic dewaxing and/or isomerization dewaxing processes.

The lube base oil and/or lube oil preferably have a pour point in the range of 10° C. or lower, more preferably 0° C. or lower, still more preferably, −15° C. or lower, and most preferably, between −15° C. and −40° C. The degree of branching in the composition is preferably kept to the minimum amount needed to arrive at the desired pour point. Pour point depressants can be added to adjust the pour point to a desired value.

The lube base oil and/or lube oil composition preferably have a kinematic viscosity of at least 3 centistokes, more preferably at least 4 centistokes, still more preferably at least 5 centistokes, and most preferably at least 1 centistokes, where the viscosity is measured at 40° C. They also have a viscosity index (a measure of the resistance of viscosity change to changes in temperature) of at least 100, preferably 140 or more, more preferably over 150, and most preferably over 160.

Another important property for the lube base oil and lube oil composition is that it has a relatively high flash point for safety reasons. Preferably, the flash point is above 90° C., more preferably above 110° C., still more preferably greater than 175° C., and most preferably between 175° C. and 300° C. The following table (Table 1) shows a correlation between viscosity and flash point of preferred lubricants for use in automobiles.

TABLE 1

| Viscosity at 40° C. (cSt) | Flash Point (D93), ° C. | Flash Point (D92), ° C. |
|---|---|---|
| 3.0 | 175 | 175 |
| 4.08 | 205 | 208 |
| 4.18 | 201 | 214 |
| 6.93 | 230 | 237 |
| 11.03 | 251 | 269 |

*D92 and D93 listed in the above table refer to ASTM tests for measuring flash point:
Flash Point, COC, ° C. D92
Flash Point, PMCC, ° C. D93

The lube oil can be used, for example, in automobiles. The high paraffinic nature of the lube oil gives it high oxidation and thermal stability, and the lube oil has a high boiling range for its viscosity, i.e., volatility is low, resulting in low evaporative losses.

The lube oil can also be used as a blending component with other oils. For example, the lube oil can be used as a blending component with polyalphaolefins, or with mineral oils to improve the viscosity and viscosity index properties of those oils, or can be combined with isomerized petroleum wax. The lube oils can also be used as workover fluids, packer fluids, coring fluids, completion fluids, and in other oil field and well-servicing applications. For example, they can be used as spotting fluids to unstick a drill pipe that has become stuck, or they can be used to replace part or all of the expensive polyalphaolefin lubricating additives in downhole applications. Additionally, they can also be used in drilling fluid formulations where shale-swelling inhibition is important, such as those described in U.S. Pat. No. 4,941,981 to Perricone et al.

Preferably, the lube oil is obtained via molecular averaging of Fischer-Tropsch products and, therefore, contains virtually no heteroatoms or saturated cyclic compounds. Alternatively, the lube oil can be obtained by molecular averaging of other feedstocks, preferably in which at least the heteroatoms, and more preferably the saturated cyclic compounds, have been removed.

Additives

The lube oil composition includes various additives, such as lubricants, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour point depressants, detergents, rust inhibitors and the like. Other hydrocarbons, such as those described in U.S. Pat. No. 5,096,883 and/or U.S. Pat. No. 5,189,012, may be blended with the lube oil provided that the final blend has the necessary pour point, kinematic viscosity, flash point, and toxicity properties. The total amount of additives is preferably between 1–30 percent. All percentages listed herein are weight percentages unless otherwise stated.

Examples of suitable lubricants include polyol esters of $C_{12}$–$C_{28}$ acids.

Examples of viscosity modifying agents include polymers such as ethylene alpha-olefin copolymers which generally have weight average molecular weights of from about 10,000 to 1,000,000 as determined by gel permeation chromatography.

Examples of suitable corrosion inhibitors include phosphosulfurized hydrocarbons and the products obtained by reacting a phosphosulfurized hydrocarbon with an alkaline earth metal oxide or hydroxide.

Examples of oxidation inhibitors include antioxidants such as alkaline earth metal salts of alkylphenol thioesters having preferably $C_5$–$C_{12}$ alkyl side chain such as calcium nonylphenol sulfide, barium t-octylphenol sulfide, dioctylphenylamine, as well as sulfurized or phosphosulfurized hydrocarbons. Additional examples include oil soluble antioxidant copper compounds such as copper salts of $C_{10}$ to $C_{18}$ oil soluble fatty acids.

Examples of friction modifiers include fatty acid esters and amides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof.

Pour point depressants such as $C_8$–$C_{18}$ dialkyl fumarate vinyl acetate copolymers, polymethacrylates and wax naphthalene are well known to those of skill in the art.

Examples of anti-foaming agents include polysiloxanes such as silicone oil and polydimethyl siloxane; acrylate polymers are also suitable.

Examples of anti-wear agents include zinc dialkyldithiophosphate, zinc diaryl diphosphate, and sulfurized isobutylene.

Examples of detergents and metal rust inhibitors include the metal salts of sulfonic acids, alkylphenols, sulfurized alkylphenols, alkyl salicylates, naphthenates and other oil soluble mono and dicarboxylic acids such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

Antioxidants can be added to the lube oil to neutralize or minimize oil degradation chemistry. Examples of antioxidants include those described in U.S. Pat. No. 5,200,101, which discloses certain amine/hindered phenol, acid anhydride and thiol ester-derived products.

The combination of a metallic dithiophosphate hydroperoxide decomposer and aminic antioxidant is reported to have a synergistic effect on lubricant antioxidant performance. See Maleville et al., *Lubrication Science*, V9, No. 1, pg. 3–60 (1996). Sulfur-substituted derivatives of mercapto carboxylic esters also are reported to possess antioxidant properties. See M. A. Mirozopeva et al., *Naftekhimiya*, V28, No. 6, pg. 831–837 (1988).

Additional lube oils additives are described in U.S. Pat. No. 5,898,023 to Francisco et al., the contents of which are hereby incorporated by reference.

Feedstocks for the Molecular Averaging Reaction

Examples of feedstocks that can be molecularly averaged in accordance with the present invention include oils that generally have relatively high pour points which it is desired to reduce to relatively low pour points. Numerous petroleum feedstocks, for example, those derived from crude oil, are suitable for use. Examples include petroleum distillates having a normal boiling point above about 100° C., gas oils and vacuum gas oils, residuum fractions from an atmospheric pressure distillation process, solvent-deasphalted petroleum residues, shale oils, cycle oils, petroleum and slack wax, waxy petroleum feedstocks, NAO wax, and waxes produced in chemical plant processes. Straight chain n-paraffins either alone or with only slightly branched chain paraffins having 16 or more carbon atoms are sometimes referred to herein as waxes.

The feedstocks should not include appreciable amounts of olefins, heteroatoms, or saturated cyclic compounds. Preferred feedstocks are products from Fischer-Tropsch synthesis or waxes from petroleum products. If any heteroatoms, olefins or saturated cyclic compounds are present in the feedstock, they should be removed before the molecular averaging reaction. Olefins and heteroatoms can be removed by hydrotreating. Saturated cyclic hydrocarbons can be separated from the desired feedstock paraffins by use of Preferred petroleum distillates for use in the relatively low molecular weight fraction boil in the normal boiling point range of 200° C. to 700° C., more preferably in the range of 260° C. to 650° C. Suitable feedstocks also include those heavy distillates normally defined as heavy straight-run gas oils and heavy cracked cycle oils, as well as conventional FCC feed and portions thereof. Cracked stocks may be obtained from thermal or catalytic cracking of various stocks. The feedstock may have been subjected to a hydrotreating and/or hydrocracking process before being supplied to the present process. Alternatively, or in addition, the feedstock may be treated in a solvent extraction process to remove aromatics and sulfur- and nitrogen-containing molecules before being dewaxed.

As used herein, the term "waxy petroleum feedstocks" includes petroleum waxes. The feedstock employed in the process of the invention can be a waxy feed which contains greater than about 50% wax, and in some embodiments, even greater than about 90% wax. Highly paraffinic feeds having high pour points, generally above about 0° C., more usually above about 10° C. are also suitable for use in the process of the invention. Such feeds can contain greater than about 70% paraffinic carbon, and in some embodiments, even greater than about 90% paraffinic carbon.

Examples of additional suitable feeds include waxy distillate stocks such as gas oils, lubricating oil stocks, synthetic oils and waxes such as those produced by Fischer-Tropsch synthesis, high pour point polyalphaolefins, foots oils, synthetic waxes such as normal alpha-olefin waxes, slack waxes, deoiled waxes and microcrystalline waxes. Foots oil is prepared by separating oil from the wax, where the isolated oil is referred to as foots oil.

Fischer-Tropsch Chemistry

In one embodiment, the relatively low molecular weight fraction (for example, a $C_{20}$ fraction) and the relatively high molecular weight fraction (for example, a $C_{40}$ fraction) are obtained via Fischer-Tropsch chemistry. Fischer-Tropsch chemistry tends to provide a wide range of products from methane and other light hydrocarbons to heavy wax. Syngas is converted to liquid hydrocarbons by contact with a Fischer-Tropsch catalyst under reactive conditions. Depending on the quality of the syngas, it may be desirable to purify the syngas prior to the Fischer-Tropsch reactor to remove carbon dioxide produced during the syngas reaction and any sulfur compounds, if they have not already been removed. This can be accomplished by contacting the syngas with a mildly alkaline solution (e.g., aqueous potassium carbonate) in a packed column.

In general, Fischer-Tropsch catalysts contain a Group VIII transition metal on a metal oxide support. The catalyst may also contain a noble metal promoter(s) and/or crystalline molecular sieves. Pragmatically, the two transition metals that are most commonly used in commercial Fischer-Tropsch processes are cobalt or iron. Ruthenium is also an effective Fischer-Tropsch catalyst but is more expensive than cobalt or iron. Where a noble metal is used, platinum and palladium are generally preferred. Suitable metal oxide supports or matrices which can be used include alumina, titania, silica, magnesium oxide, silica-alumina, and the like, and mixtures thereof.

Although Fischer-Tropsch processes produce a hydrocarbon product having a wide range of molecular sizes, the selectivity of the process toward a given molecular size range as the primary product can be controlled to some extent by the particular catalyst used. In the present process, it is preferred to produce $C_{20}$–$C_{50}$ paraffins as the primary product, and therefore, it is preferred to use a cobalt catalyst although iron catalysts may also be used. One suitable catalyst that can be used is described in U.S. Pat. No. 4,579,986 as satisfying the relationship:

$$(3+4R)>L/S>(0.3+0.4R),$$

wherein:

L=the total quantity of cobalt present on the catalyst, expressed as mg Co/ml catalyst, S=the surface area of the catalyst, expressed as $m^2$/ml catalyst, and R=the weight ratio of the quantity of cobalt deposited on the catalyst by kneading to the total quantity of cobalt present on the catalyst.

Preferably, the catalyst contains about 3–60 ppw cobalt, 0.1–100 ppw of at least one of zirconium, titanium or chromium per 100 ppw of silica, alumina, or silica-alumina and mixtures thereof. Typically, the synthesis gas will contain hydrogen, carbon monoxide and carbon dioxide in a relative mole ratio of about from 0.25 to 2 moles of carbon monoxide and 0.01 to 0.05 moles of carbon dioxide per mole of hydrogen. It is preferred to use a mole ratio of carbon monoxide to hydrogen of about 0.4 to 1, more preferably 0.5 to 0.7 moles of carbon monoxide per mole of hydrogen with only minimal amounts of carbon dioxide; preferably less than 0.5 mole percent carbon dioxide.

The Fischer-Tropsch reaction is typically conducted at temperatures between about 300° F. and 700° F. (149° C. to 371° C.), preferably, between about 400° F. and 550° F. (204° C. to 228° C.). The pressures are typically between about 10 and 500 psia (0.7 to 34 bars), preferably between about 30 and 300 psia (2 to 21 bars). The catalyst space velocities are typically between about from 100 and 10,000 cc/g/hr., preferably between about 300 and 3,000 cc/g/hr.

The reaction can be conducted in a variety of reactors for example, fixed bed reactors containing one or more catalyst beds, slurry reactors, fluidized bed reactors, or a combination of different type reactors.

In a preferred embodiment, the Fischer-Tropsch reaction is conducted in a bubble column slurry reactor. In this type of reactor synthesis gas is bubbled through a slurry that includes catalyst particles in a suspending liquid. Typically, the catalyst has a particle size of between 10 and 110 microns, preferably between 20 and 80 microns, more preferably between 25 and 65 microns, and a density of between 0.25 and 0.9 g/cc, preferably between 0.3 and 0.75 g/cc. The catalyst typically includes one of the aforementioned catalytic metals, preferably cobalt on one of the aforementioned catalyst supports. Preferably, the catalyst comprises about 10 to 14 percent cobalt on a low density fluid support, for example alumina, silica and the like having a density within the ranges set forth above for the catalyst. Since the catalyst metal may be present in the catalyst as oxides, the catalyst is typically reduced with hydrogen prior to contact with the slurry liquid. The starting slurry liquid is typically a heavy hydrocarbon which is viscous enough to keep the catalyst particles suspended (typically a viscosity between 4–100 centistokes at 100° C.) and a low enough volatility to avoid vaporization during operation (typically an initial boiling point range of between about 350° C. and 550° C.). The slurry liquid is preferably essentially free of contaminants such as sulfur, phosphorous or chlorine compounds. Initially, it may be desirable to use a synthetic hydrocarbon fluid such as a synthetic olefin oligomer as the slurry fluid.

Often, a paraffin fraction of the product having the desired viscosity and volatility is recycled as the slurry liquid. The slurry typically has a catalyst concentration of between about 2 and 40 percent catalyst, preferably between about 5 and 20 percent, and more preferably between about 7 and 15 percent catalyst based on the total weight of the catalyst, i.e., metal plus support. The syngas feed typically has a hydrogen to carbon monoxide mole ratio of between about 0.5 and 4 moles of hydrogen per mole of carbon monoxide, preferably between about 1 and 2.5 moles, and more preferably between about 1.5 and 2 moles.

The bubble slurry reactor is typically operated at temperatures within the range of between about 150° C. and 300° C., preferably between about 185° C. and 265° C., and more preferably between about 210° C. and 230° C., at pressures within the range of between about 1 and 70 bar, preferably between about 6 and 35 bar, and most preferably between about 10 and 30 bar (1 bar=14.5 psia). Typical synthesis gas linear velocity ranges in the reactor are from about 2 to 40 cm per sec., preferably from about 6 to 10 cm per sec. Additional details regarding bubble column slurry reactors can be found, for example, in Y. T. Shah et al., "Design Parameters Estimations for Bubble Column Reactors", *AIChE Journal*, 28 No. 3, pp. 353–379 (May 1982); Ramachandran et al., "Bubble Column Slurry Reactor, Three-Phase Catalytic Reactors", Chapter 10, pp. 308–332, Gordon and Broch Science Publishers (1983); Deckwer et al., "Modeling the Fischer-Tropsch Synthesis in the Slurry Phase", *Ind. Eng. Chem. Process Des. Dev.*, v 21, No. 2, pp. 231–241 (1982); Kölbel et al., "The Fischer-Tropsch Synthesis in the Liquid Phase", *Catal. Rev.-Sci. Eng.*, v. 21(n), pp. 225–274 (1980); and U.S. Pat. No. 5,348,982, the contents of each of which are hereby incorporated by reference in their entirety.

Although the relatively high and relatively low molecular weight fractions used in the process described herein are described herein in terms of a Fischer-Tropsch reaction product, these fractions can also be obtained through various modifications of the literal Fischer-Tropsch process by which hydrogen (or water) and carbon monoxide (or carbon dioxide) are converted to hydrocarbons (e.g., paraffins, ethers, etc.) and to the products of such processes. Thus, the term Fischer-Tropsch type product or process is intended to apply to Fischer-Tropsch processes and products and the various modifications thereof and the products thereof. For example, the term is intended to apply to the Kolbel-Engelhardt process typically described by the reactions $$3CO+H_2O \rightarrow —CH_2— +2CO_2$$

$$CO_2+3H_2 \rightarrow —CH_2— +2H_2O$$

The Separation of Product From the Fischer-Tropsch Reaction

The products from Fischer-Tropsch reactions generally include a gaseous reaction product and a liquid reaction product. The gaseous reaction product includes hydrocarbons boiling below about 650° F. (e.g., tail gases through middle distillates). The liquid reaction product (the condensate fraction) includes hydrocarbons boiling above about 650° F. (e.g., vacuum gas oil through heavy paraffins).

The minus 650° F. product can be separated into a tail gas fraction and a condensate fraction, i.e., about $C_5$ to $C_{20}$ normal paraffins and higher boiling hydrocarbons, using, for example, a high pressure and/or lower temperature vapor-liquid separator or low pressure separators or a combination of separators. While the preferred fractions for preparing the lube oil composition generally include $C_{20}$ and $C_{40}$ paraffins, paraffins with a lower molecular weight, such as those in the above fractions, can also be used.

The fraction boiling above about 650° F. (the condensate fraction), after removal of the particulate catalyst, is typically separated into a wax fraction boiling in the range of about 650°F.–1200° F. primarily about containing $C_{20}$ to $C_{50}$ linear paraffins with relatively small amounts of higher boiling branched paraffins and one or more fractions boiling above about 1200° F. Typically, the separation is effected by fractional distillation.

Products in the desired range (for example, $C_{20}$–$C_{50}$, preferably around $C_{30}$) are preferably isolated and used directly to prepare lube base oil compositions. Products in the relatively low molecular weight fraction (for example, $C_{20}$, distillate fuels) and the relatively high molecular weight fraction (for example, $C_{40}$, 1000° F.+wax) can be isolated and combined for molecular redistribution/averaging to arrive at a desired fraction. The product of the molecular averaging reaction can be distilled to provide a desired fraction, and also relatively low and high molecular weight fractions, which can be reprocessed in the molecular averaging stage.

To prepare a product in the $C_{20}$–$C_{50}$ range, one can combine the fractions below $C_{20}$ with those above $C_{50}$ (1000° F.+wax, or the "heavy" fraction). To prepare a product in the $C_{30}$ range, it may be preferable to combine a $C_{20}$ fraction with a $C_{40}$ fraction, as the molecular averaging tends to provide a roughly statistical mixture of products intermediate in molecular weight to the starting materials. More product in the desired range is produced when the reactants have molecular weights closer to the target molecular weight. Of course, following fractional distillation and isolation of the product of the molecular averaging reaction, the other fractions can be isolated and re-subjected to molecular averaging conditions.

In one embodiment, since the fractions will be averaged, the fraction with the desired molecular weight is not removed prior to molecular averaging. However, the molecular averaging tends to somewhat reduce the VI and other beneficial properties of the resulting lube oil compositions, so it is preferred that the desired fraction be obtained directly from the Fischer-Tropsch chemistry, and a second desired fraction obtained via molecular averaging.

Hydrotreating and/or Hydrocracking Chemistry

Fractions used in the molecular averaging chemistry may include heteroatoms such as sulfur or nitrogen that may adversely affect the catalysts used in the molecular averaging reaction. If sulfur impurities are present in the starting materials, they can be removed using means well known to those of skill in the art, for example, extractive Merox, hydrotreating, adsorption, etc. Nitrogen-containing impurities can also be removed using means well known to those of skill in the art. Hydrotreating and hydrocracking are preferred means for removing these and other impurities.

Accordingly, it is preferred that these fractions be hydrotreated and/or hydrocracked to remove the heteroatoms before performing the molecular averaging process described herein. Hydrogenation catalysts can be used to hydrotreat the products resulting from the Fischer-Tropsch, molecular averaging and/or isomerization reactions.

As used herein, the terms "hydrotreating" and "hydrocracking" are given their conventional meaning and describe processes that are well known to those skilled in the art. Hydrotreating refers to a catalytic process, usually carried out in the presence of free hydrogen, in which the primary purpose is the desulfurization and/or denitrification of the feedstock. Generally, in hydrotreating operations, cracking of the hydrocarbon molecules, i.e., breaking the larger hydrocarbon molecules into smaller hydrocarbon molecules, is minimized and the unsaturated hydrocarbons are either fully or partially hydrogenated.

Hydrocracking refers to a catalytic process, usually carried out in the presence of free hydrogen, in which the cracking of the larger hydrocarbon molecules is a primary purpose of the operation. Desulfurization and/or denitrification of the feed stock usually will also occur.

Catalysts used in carrying out hydrotreating and hydrocracking operations are well known in the art. See, for example, U.S. Pat. Nos. 4,347,121 and 4,810,357 for general descriptions of hydrotreating, hydrocracking, and typical catalysts used in each process.

Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. No. 4,157,294 and U.S. Pat. No. 3,904,513. The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation. Although these components can be combined with the catalyst matrix as the sulfides, that is generally not preferred, as the sulfur compounds can interfere with the molecular averaging or Fischer-Tropsch catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO); 4,913,799 and the various references cited in U.S. Pat. No. 4,913,799. Mesoporous molecular sieves can also be used, for example, the M41S family of materials (*J. Am. Chem. Soc.* 1992, 114, 10834–10843), MCM-41 (U.S. Pat. Nos. 5,246, 689, 5,198, 203 and 5,334,368), and MCM48 (Kresge et al., *Nature* 359 (1992) 710).

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

The contents of each of the patents and publications referred to above are hereby incorporated by reference in its entirety.

Molecular Redistribution/Averaging

As used herein, "molecular redistribution" is a process in which a single paraffin is converted into a mixture of lighter and heavier paraffins, or in which a mixture of paraffins is converted into a paraffin with a narrow size distribution. The latter technique is also known as "molecular averaging". The term "disproportionation" is also used herein to describe molecular averaging.

Molecular averaging uses conventional catalysts, such as $Pt/Al_2O_3$ and $WO_3SiO_2$ (or inexpensive variations). The chemistry does not require using hydrogen gas, and therefore does not require relatively expensive recycle gas compressors. The chemistry is typically performed at mild pressures (100–5000 psig). The chemistry is typically thermoneutral and, therefore, there is no need for additional equipment to control the temperature.

Molecular averaging is very sensitive to sulfur impurities in the feedstock, and these must be removed prior to the reaction. Typically, if the paraffins being averaged result from a Fischer-Tropsch reaction, they do not contain sulfur. However, if the paraffins resulted from another process, for example, distillation of crude oil, they may contain sufficient sulfur impurities to adversely effect the molecular averaging chemistry.

The presence of excess olefins and hydrogen in the disproportionation zone are also known to effect the equilibrium of the disproportionation reaction and to deactivate the catalyst. Since the composition of the fractions may vary, some routine experimentation will be necessary to identify the contaminants that are present and identify the optimal processing scheme and catalyst to use in carrying out the invention.

Molecular averaging generally involves two distinct chemical reactions. First, the paraffins are converted into olefins on the platinum catalyst in a process known as dehydrogenation or unsaturation. The olefins are disproportionated into lighter and heavier olefins by a process known as olefin metathesis. The metathesized olefins are then converted into paraffins on the platinum catalyst in a process known as hydrogenation or saturation.

The relatively low molecular weight fractions (i.e., at or below $C_{20}$) and relatively high molecular weight fraction (i.e., at or above $C_{40}$) are molecularly averaged to a desired fraction (i.e., at or around $C_{30}$) fraction using an appropriate molecular averaging catalyst under conditions selected to convert a significant portion of the relatively high molecular weight and relatively low molecular weight fractions to a desired fraction.

Various catalysts are known to catalyze the molecular averaging reaction. The catalyst mass used to carry out the present invention must have both dehydrogenation/hydrogenation activity and molecular averaging activity. The dehydrogenation activity is believed to be necessary to convert the alkanes in the feed to olefins, which are believed to be the actual species that undergo olefin metathesis. Following olefin metathesis, the olefin is converted back into an alkane. It is theorized that the dehydrogenation/hydrogenation activity of the catalyst also contributes to rehydrogenation of the olefin to an alkane. While it is not intended that the present invention be limited to any particular mechanism, it may be helpful in explaining the choice of catalysts to further discuss the sequence of chemical reactions which are believed to be responsible for molecular averaging of the alkanes. As an example, the general sequence of reactions for $C_{20}$ and $C_{40}$ fractions is believed to be:

$$C_{20}H_{42}+C_{40}H_{82}\leftrightarrows C_{20}H_{40}+C_{40}H_{80}+2H_2\leftrightarrows 2\ C_{30}H_{60}+2H_2\leftrightarrows 2C_{30}H_{62}$$

The catalyst mass for use in the molecular averaging reaction will be dual function and may have the two functions on the same catalyst particle or may consist of different catalysts having separate dehydrogenation/hydrogenation and molecular averaging components within the catalyst mass. The dehydrogenation/hydrogenation function within the catalyst mass usually will include a Group VIII metal from the Periodic Table of the Elements which includes iron, cobalt, nickel, palladium, platinum, rhodium, ruthenium, osmium, and iridium.

Platinum and palladium or the compounds thereof are preferred for inclusion in the dehydrogenation/hydrogenation component, with platinum or a compound thereof being especially preferred. As noted previously, when referring to a particular metal in this disclosure as being useful in the present invention, the metal may be present as elemental metal or as a compound of the metal. As discussed above, reference to a particular metal in this disclosure is not intended to limit the invention to any particular form of the metal unless the specific name of the compound is given, as in the examples in which specific compounds are named as being used in the preparations.

In the event the catalyst deactivates with the time-on-stream, specific processes that are well known to those skilled in art are available for the regeneration of the catalysts.

Usually, the molecular averaging component of the catalyst mass will include one or more of a metal or the compound of a metal from Group VIB or Group VIIB of the Periodic Table of the Elements, which include chromium, manganese, molybdenum, rhenium and tungsten. Preferred for inclusion in the molecular averaging component are molybdenum, rhenium, tungsten, and the compounds thereof. Particularly preferred for use in the molecular averaging component is tungsten or a compound thereof. As discussed, the metals described above may be present as elemental metals or as compounds of the metals, such as, for example, as an oxide of the metal. It is also understood that the metals may be present on the catalyst component either alone or in combination with other metals.

In most cases, the metals in the catalyst mass will be supported on a refractory material. Refractory materials suitable for use as a support for the metals include conventional refractory materials used in the manufacture of catalysts for use in the refining industry. Such materials include, but are not necessarily limited to, alumina, zirconia, silica, boria, magnesia, titania and other refractory oxide material or mixtures of two or more of any of the materials. The support may be a naturally occurring material, such as clay, or synthetic materials, such as silica-alumina and borosilicates. Molecular sieves, such as zeolites, also have been used as supports for the metals used in carrying out the dual functions of the catalyst mass. See, for example, U.S. Pat. No. 3,668,268. Mesoporous materials such as MCM-41 and MCM-48, such as described in Kresge, C. T., et al., *Nature* (Vol. 359) pp. 710–712, 1992, may also be used as a refractory support. Other known refractory supports, such as carbon, may also serve as a support for the active form of the metals in certain embodiments of the present invention. The support is preferably non-acidic, i.e., having few or no free acid sites on the molecule. Free acid sites on the support may be neutralized by means of alkali metal salts, such as those of lithium. Alumina, particularly alumina on which the acid sites have been neutralized by an alkali salt, such as lithium nitrate, is usually preferred as a support for the dehydrogenation/hydrogenation component, and silica is usually preferred as the support for the disproportionation component.

The amount of active metal present on the support may vary, but it must be at least a catalytically active amount, i.e., a sufficient amount to catalyze the desired reaction. In the case of the dehydrogenation/hydrogenation component, the active metal content will usually fall within the range from about 0.01 weight percent to about 50 weight percent on an elemental basis, with the range of from about 0.1 weight percent to about 20 weight percent being preferred. For the molecular averaging component, the active metals content will usually fall within the range of from about 0.01 weight percent to about 50 weight percent on an elemental basis, with the range of from about 0.1 weight percent to about 15 weight percent being preferred.

A typical molecular averaging catalyst for use in the present invention includes a platinum component and a tungsten component is described in U.S. Pat. No. 3,856,876, the entire disclosure of which is herein incorporated by reference. In one embodiment of the present invention, a catalyst is employed which comprises a mixture of platinum-on-alumina and tungsten-on-silica, wherein the volumetric ratio of the platinum component to the tungsten component is greater than 1:50 and less than 50:1. Preferably, the volumetric ratio of the platinum component to the tungsten component in this particular embodiment is between 1:10 and 10:1. The percent of surface of the metals should be maximized with at least 10% of the surface metal atoms exposed to the reactant.

Both the dehydrogenation/hydrogenation component and the molecular averaging component may be present within the catalyst mass on the same support particle as, for example, a catalyst in which the dehydrogenation/hydrogenation component is dispersed on an unsupported molecular averaging component such as tungsten oxide. In another embodiment of the invention, the catalyst components may be separated on different particles. When the dehydrogenation/hydrogenation component and the molecular averaging component are on separate particles, it is preferred that the two components be in close proximity to one another, as for example, in a physical mixture of the particles containing the two components. However, in other embodiments of the invention, the components may be physically separated from one another, as for example, in a process in which separate dehydrogenation/hydrogenation and molecular averaging zones are present in the reactor.

In a reactor having a layered fixed catalyst bed, the two components may, in such an embodiment, be separated in different layers within the bed. In some applications, it may even be advantageous to have separate reactors for carrying out the dehydrogenation and molecular averaging steps. However, in processing schemes where the dehydrogenation of the alkanes to olefins occurs separately from the molecular averaging reaction of the olefins, it may be necessary to include an additional hydrogenation step in the process, since the rehydrogenation of the olefins must take place after the molecular averaging step.

The process conditions selected for carrying out the present invention will depend upon the molecular averaging catalyst used. In general, the temperature in the reaction zone will be within the range of from about 400° F. (200° C.) to about 1000° F. (540° C.) with temperatures in the range of from about 500° F. (260° C.) to about 850° F. (455° C.) usually being preferred. In general, the conversion of the alkanes by molecular averaging increases with an increase in pressure. Therefore, the selection of the optimal pressure for carrying out the process will usually be at the highest practical pressure under the circumstances. Accordingly, the pressure in the reaction zone should be maintained above 100 psig, and preferably the pressure should be maintained above 500 psig. The maximum practical pressure for the practice of the invention is about 5000 psig. More typically, the practical operating pressure will below about 3000 psig. The feedstock to the molecular averaging reactor should contain a minimum of olefins, and preferably should contain no added hydrogen.

Saturated and partially saturated cyclic hydrocarbons (cycloalkanes, aromatic-cycloalkanes, and alkyl derivatives of these species) can form hydrogen during the molecular averaging reaction. This hydrogen can inhibit the reaction, thus these species should be substantially excluded from the feed. The desired paraffins can be separated from the saturated and partially saturated cyclic hydrocarbons by deoiling or by use of molecular sieve adsorbents, or by deoiling or by extraction with urea. These techniques are well known in the industry. Separation with urea is described by Hepp, Box and Ray in *Ind. Eng. Chem.*, 45: 112 (1953). Fully aromatic cyclic hydrocarbons do not form hydrogen and can be tolerated. Polycyclic aromatics can form carbon deposits, and these species should also be substantially excluded from the feed. This can be done by use of hydrotreating and hydrocracking.

Platinum/tungsten catalysts are particularly preferred for carrying out the present invention because the molecular averaging reaction will proceed under relatively mild conditions. When using the platinum/tungsten catalysts, the temperature should be maintained within the range of from about 400° F. (200° C.) to about 1000° F. (540° C.), with temperatures above about 500° F. (260° C.) and below about 800° F. being particularly desirable.

The molecular averaging reaction described above is reversible, which means that the reaction proceeds to an equilibrium limit. Therefore, if the feed to the molecular averaging zone has two streams of alkanes at different molecular weights, then equilibrium will drive the reaction to produce product having a molecular weight between that of the two streams. The zone in which the molecular averaging occurs is referred to herein as a molecular averaging zone. It is desirable to reduce the concentration of the desired products in the molecular averaging zone to as low a concentration as possible to favor the reactions in the desired direction. As such, some routine experimentation may be necessary to find the optimal conditions for conducting the process.

Any number of reactors can be used, such as fixed bed, fluidized bed, ebulated bed, and the like. An example of a suitable reactor is a catalytic distillation reactor.

When the relatively high molecular weight and relatively low molecular weight fractions are combined, it may be advantageous to take representative samples of each fraction and subject them to molecular averaging, while adjusting the relative amounts of the fractions until a product with desired properties is obtained. Then, the reaction can be scaled up using the relative ratios of each of the fractions that resulted in the desired product. Using this method, one can "dial in" a molecular weight distribution which can be roughly standardized between batches and result in a reasonably consistent product.

Isomerization Chemistry

The relatively low molecular weight fraction can be isomerized prior to molecular averaging to incorporate branching into the product of the molecular averaging reaction. In addition, the product of the molecular averaging and/or any other hydrocarbon fractions in the lube base oil range which need their pour point adjusted can be isomerized. The processes for isomerizing relatively low molecular weight fractions tend to be different than those for isomerizing hydrocarbons in the lube base oil range.

Isomerization processes for light fractions boiling lighter than $C_{10}$ are generally carried out at a temperature between 200° F. and 700° F., preferably 300° F. to 550° F. The liquid hourly space velocity (LHSV) is typically between 0.1 and 5, more preferably between 0.25 and 2.0, employing hydrogen such that the hydrogen to hydrocarbon mole ratio is between 1:1 and 5:1. Catalysts useful for isomerization are generally bifunctional catalysts comprising a hydrogenation component (preferably selected from the Group VIII metals of the Periodic Table of the Elements, and more preferably selected from the group consisting of nickel, platinum, palladium and mixtures thereof) and an acid component. Examples of an acid component useful in the preferred isomerization catalyst include a crystalline molecular sieve, a halogenated alumina component, or a silica-alumina component. Such paraffin isomerization catalysts are well known in the art.

The heavier molecular weight products and reactants can be isomerized using slightly different conditions and catalysts. Suitable catalysts for isomerizing these products and reactants are described, for example, in U.S. Pat. Nos. 5,282,958, 5,246,566, 5,135,638 and 5,082,986, the contents of which are hereby incorporated by reference. Although the crystal size limits described in U.S. Pat. No. 5,282,958 may be preferred, they are not essential, and larger and/or smaller crystal sizes can be used. A molecular sieve is used as one component. The sieve has pore sizes of less than about 7.1 angstroms, preferably less than about 6.5 angstroms, has at least one pore diameter greater than about 4.8 angstroms. The catalyst is further characterized in that it has sufficient acidity to convert at least 50% of hexadecane at 370° C., and exhibits a 40 or greater isomerization selectivity ratio as defined in U.S. Pat. No. 5,282,958 at 96% hexadecane conversion. Specific examples of molecular sieves which can be used include ZSM-12, ZSM-21, ZSM-22, ZSM-23, ZSM-35, ZSM-38, ZSM48, ZSM-57, SSZ-32, SSZ-35, Ferrierite, L-type zeolite, SAPO-11, SAPO-31, SAPO-41, MAPO-11 and MAPO-31.

Optionally, the resulting isomerized products are hydrogenated. After hydrogenation, which typically is a mild hydrofinishing step, the resulting lube oil product is highly paraffinic and has excellent lubricating properties. Hydrofinishing is done after isomerization. Hydrofinishing is well known in the art. Typical reaction conditions include temperatures ranging from about 190° C. to about 340° C. and pressures of from about 400 psig to about 3000 psig, at space velocities (LHSV) of from about 0.1 to about 20, and hydrogen recycle rates of from about 400 to about 1500 SCF/bbl.

The hydrofinishing step is beneficial in preparing an acceptably stable lubricating oil. Lubricant oils that do not receive the hydrofinishing step may be unstable in air and light and tend to form sludges.

The process will be readily understood by referring to the flow diagram in the FIGURE. In the flow scheme contained in the FIGURE, the process of the present invention is practiced in batch operation. However, it is possible to practice the present invention in continuous operation. The reaction scheme shown in the figure permits many optional stages in which isomerization and/or hydrogenation of the various reactants and products can occur. Each of these optional stages is indicated below.

Box 10 is a reactor that reacts syngas in the presence of an appropriate Fischer-Tropsch catalyst to form Fischer-Tropsch products. These products are fractionally distilled (Box 20), forming a relatively low molecular weight fraction which is sent to a separate reactor (Box 60) for molecular averaging, a desired fraction which is isolated in Box 50, and a relatively high molecular weight fraction which is also sent to a reactor (Box 60) for molecular averaging. Following molecular averaging, the reaction mixture is fractionally distilled (Box 20), where the desired product is isolated in Box 40, and the relatively high and low molecular weight fractions are optionally sent back to the molecular averaging stage (Box 60).

Between the distillation stage and the storage and/or molecular averaging stages, the fractions can be isomerized (Box 30) and/or hydrotreated (Box 40). After the desired fractions are all obtained and stored in Box 40, they can be isomerized (Box 30) and/or hydrotreated (Box 50). The unprocessed material in the desired molecular weight range is a hydrocarbon which can be isomerized to form a lube base oil. The lube base oil can be blended with additives (Box 70) to form the lube oil composition. Each of the isomerization stages is optional, but it is preferred that isomerization occur at least once in the overall process.

While the present invention has been described with reference to specific embodiments, this application is intended to cover those various changes and substitutions that may be made by those skilled in the art without departing from the spirit and scope of the appended claims.

What is claimed is:

1. A process for preparing a hydrocarbon in the lube base oil range, the process comprising:

(a) combining a paraffinic fraction with an average molecular weight below a desired molecular weight for a lube base oil with a paraffinic fraction with average molecular weight above a desired molecular weight for a lube base oil in a suitable proportion such that, when the molecular weights of the paraffinic fractions are averaged, the average molecular weight is the desired molecular weight for a lube base oil;

(b) subjecting the paraffinic fractions to molecular averaging to provide a product with the desired molecular weight; and (c) isolating the product.

2. The process of claim 1, wherein at least one of the fractions with an average molecular weight below the desired molecular weight for a lube base oil and the fraction with an average molecular weight above the desired molecular weight for a lube base oil is prepared via a Fischer-Tropsch process.

3. The process of claim 1, wherein at least one of the fractions with an average molecular weight below the desired molecular weight for a lube base oil and the fraction with an average molecular weight above the desired molecular weight for a lube base oil is obtained via distillation of crude oil, provided that the at least one fraction obtained via distillation of crude oil does not include appreciable amounts of olefins, cyclic compounds or heteroatoms.

4. The process of claim 1, wherein the product is isolated via fractional distillation.

5. The process of claim 1, further comprising isomerization of the resulting product.

6. The process of claim 1, further comprising hydrotreating the resulting product.

7. The process of claim 4, further comprising isolating fractions with relatively high and low molecular weights and recycling at least a portion of these fractions to step (a).

8. The process of claim 5, wherein the fraction with the desired molecular weight is combined with a lube oil additive selected from the group consisting of lubricants, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour point depressants, detergents, and rust inhibitors.

9. The process of claim 1, wherein one or more of the fractions are hydrotreated to remove compounds selected from the group consisting of heteroatoms, olefins, cyclic compounds, and combinations thereof prior to the molecular averaging.

10. The process of claim 1, wherein the fraction with an average molecular weight below the desired molecular weight for a lube base oil is isomerized prior to the molecular averaging step.

11. The process of claim 5, wherein the pour point of the product is less than 10° C.

12. The process of claim 5, wherein the pour point of the product is less than 0° C.

13. The process of claim 5, wherein the pour point of the product is less than −15° C.

14. The process of claim 5, wherein the pour point of the product is between −15 and −40° C.

15. The process of claim 5, wherein the viscosity index of the product is greater than 100.

16. The process of claim 5, wherein the viscosity index of the product is greater than 140.

17. The process of claim 5, wherein the viscosity index of the product is greater than 150.

18. The process of claim 5, wherein the kinematic viscosity of the product is about 3 centipoises or more.

19. The process of claim 5, wherein the kinematic viscosity of the product is about 4 centipoises or more.

20. The process of claim 1, wherein the fraction with an average molecular weight below that of the desired product is roughly a $C_{20}$ fraction.

21. The process of claim 1, wherein the fraction with an average molecular weight above that of the desired product is roughly a $C_{40}$ fraction.

22. The process of claim 1, wherein the desired average molecular weight is approximately $C_{30}$.

23. The process of claim 1, wherein the fraction with the desired molecular weight has a boiling point in the range of between 650° F. and 1200° F.

24. The process of claim 1, wherein the fraction with the desired molecular weight has a boiling point in the range of between 700° F. and 1100° F.

25. A process for preparing a hydrocarbon in the lube base oil range, the process comprising:

(a) performing Fischer-Tropsch synthesis on syngas to provide a product stream, (b) fractionally distilling the product stream and isolating fractions;

(c) storing a fraction with the desired molecular weight;

(d) combining a fraction an average molecular weight below the desired molecular weight for a lube base oil with a fraction with average molecular weight above the desired molecular weight for a lube base oil in a suitable proportion such that, when the molecular weights of the fractions are averaged, the average molecular weight is approximately that of the desired molecular weight;

(e) subjecting the fractions in step d) to molecular averaging to provide a product with the desired molecular weight; and (f) fractionally distilling the product and isolating the fraction with the desired molecular weight.

26. The process of claim 25, further comprising combining at least a portion of the fractions in steps (c) and (f) and isomerizing them to form a lube base oil.

27. The process of claim 25, further comprising hydrotreating the product.

28. The process of claim 25, further comprising blending the product with one or more additional lube base oils.

29. The process of claim 25, further comprising isolating fractions with relatively high and low molecular weights and recycling at least a portion of these fractions to step (a).

30. The process of claim 25, wherein the fraction with an average molecular weight below a target molecular weight and/or the fraction with average molecular weight above a target molecular weight are obtained via distillation of crude oil, provided that the fraction does not include appreciable amounts of olefins, saturated and partially saturated cyclic compounds or heteroatoms, wherein the feed to the molecular averaging step is hydrotreated prior to molecular averaging.

31. The process of claim 26, further comprising blending the product with one or more lube oil additives selected from the group consisting of lubricants, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour point depressants, detergents, and rust inhibitors.

* * * * *

UNITED STATES PATENT AND TRADEMARK OFFICE

CERTIFICATE OF CORRECTION

PATENT NO. : 6,562,230 B1
DATED : May 13, 2003
INVENTOR(S) : Dennis O'Rear

It is certified that error appears in the above-identified patent and that said Letters Patent is hereby corrected as shown below:

Title page,
Item [73], Assignee, add the following: -- Chevron U.S.A., Inc. --

Signed and Sealed this

Twenty-first Day of December, 2004

JON W. DUDAS
*Director of the United States Patent and Trademark Office*